US005489501A

United States Patent [19]

Torii et al.

[11] Patent Number: 5,489,501

[45] Date of Patent: Feb. 6, 1996

[54] RECORDING COMPOSITION

[75] Inventors: Masafumi Torii, Shizuoka; Kunio Hayakawa, Gotenba, both of Japan

[73] Assignee: Ricoh Company, Ltd., Tokyo, Japan

[21] Appl. No.: 325,121

[22] Filed: Oct. 18, 1994

[30] Foreign Application Priority Data

| | | | |
|---|---|---|---|
| Oct. 18, 1993 | [JP] | Japan | 5-283961 |
| Nov. 18, 1993 | [JP] | Japan | 5-312553 |
| Dec. 18, 1993 | [JP] | Japan | 5-344165 |
| Oct. 14, 1994 | [JP] | Japan | 6-276034 |
| Oct. 14, 1994 | [JP] | Japan | 5-346474 |

[51] Int. Cl.[6] ..... B41M 5/26

[52] U.S. Cl. ..... 430/341; 430/964; 503/212; 503/211; 503/210

[58] Field of Search ..... 503/212, 211, 503/210; 430/341, 964

[56] References Cited

U.S. PATENT DOCUMENTS

| | | | |
|---|---|---|---|
| 3,157,526 | 11/1964 | Johnson et al. | 503/211 |
| 3,859,111 | 1/1975 | Takanishi et al. | 503/211 |
| 4,602,264 | 7/1986 | Shioi et al. | 346/205 |
| 4,829,046 | 5/1989 | Whitcomb | 503/211 |

FOREIGN PATENT DOCUMENTS

| | | | |
|---|---|---|---|
| 63-183875 | 7/1988 | Japan | 503/211 |

*Primary Examiner*—Charles L. Bowers, Jr.
*Assistant Examiner*—John A. McPherson
*Attorney, Agent, or Firm*—Oblon, Spivak, McClelland, Maier & Neustadt

[57] ABSTRACT

A recording material contains at least two coordination compounds which react to produce at least one newly produced coordination compound with the occurrence of visual changes in the recording material, which visual changes are utilized for recording.

14 Claims, No Drawings

RECORDING COMPOSITION

BACKGROUND OF THE INVENTION

1. Field of the Invention

The present invention relates to a recording material utilizing a novel coloring mechanism, having excellent background preservability with minimum coloring of the background.

2. Discussion of Background

Generally, recording materials comprise a support and a recording layer formed thereon, which comprises as main components a colorless or light colored electron-donating dye precursor, and an electron-accepting color developer. These dye precursor and color developer are caused to react instantly upon the application of recording energy thereto to produce recorded images, for instance, by thermosensitive recording method, pressure-sensitive recording method and non-impact electric recording method, and the like, as disclosed in Japanese Patent Publications 43-4160 and 45-14039.

Recording materials utilizing such an electron-donating dye precursor and an electron-accepting color developer have advantages over other recording materials that they have excellent characteristics such as good appearance, nice touch and being capable of producing images with high coloring density, but also have disadvantage that the image preservability thereof is poor. Specifically, when image areas come into contact with plastics such as polyvinyl chloride, images are decolorized by plasticizers and additives contained in such plastics, or when image areas come into contact with chemicals contained in foods or cosmetics, such image areas are easily decolorized, or the background thereof is easily colored.

In addition to the above recording materials, chelate according materials recording materials are known, which utilize metallic compounds. More specifically, Japanese Patent Publications 32-8787 and 34-6485 disclose chelate recording materials comprising an organic reducing agent, chelating agent, or a sulfur compound as an electron donator, and an organic acid metal salt as an electron acceptor as examples of such chelate recording materials.

However, in comparison with leuco recording materials, such chelate recording materials have excellent solvent resistance and plasticizer resistance, but have two significant drawbacks that the background thereof is colored when coming into contact with plasticizers, and the recording sensitivity thereof is low.

In order to prevent the coloring of the background, the above-mentioned Japanese Patent Publications propose recording materials comprising an organic metal salt in one layer, and an organic reducing agent, a chelate agent or a sulfur compound in another layer. According to this method, the problem of the coloring of the background can be solved, but the recording sensitivity is further decreased. Furthermore, the above-mentioned Japanese Patent Publications propose the use of a metal soap as a sensitizer, but the use of a metal soap causes background fogging and considerably reduces the preservability of the recording material.

Many proposals have been made in an attempt to solve these problems of the conventional recording materials, but those problems have not yet been solved completely.

SUMMARY OF THE INVENTION

It is therefore an object of the present invention to provide a recording material from which the shortcomings of the conventional leuco recording materials and chelate thermosensitive recording materials have been eliminated, and which has excellent preservability with respect to recorded images and the background thereof, and improved coloring performance with such excellent preservability.

This object of the present invention can be achieved by a recording material comprising a plurality of coordination compounds which reacts to produce at least one newly produced coordination compound with the occurrence of visual changes in the recording material, which visual changes are utilized for recording.

The recording material may further comprising an acid material. The acid material may comprise a sulfonic acid ester with a thermal decomposition temperature of 60° C. or more.

The recording material may further comprises a water-releasing material. The water-releasing material may be selected from the group consisting of a compound of formula (I) and a compound of formula (II):

$$M^1M^3(SO_4)_2.12H_2O \quad (I)$$

$$M^1{}_2SO_4.M^3{}_2(SO_4)_3.24H_2O \quad (II)$$

wherein $M^1$ is a monovalent metal, ammonium, or alkyl ammonium; and $M^3$ is a trivalent metal.

The recording material may further comprise pullulan, together with the water-releasing material.

The recording material may further comprise a compound comprising a metal which is capable of forming a coordination compound having a stability Kr which satisfies the following formula (III) when the coordination compounds have stabilities $K_1$ to $K_n$, and the newly produced coordination compound has a stability Kz when the newly produced coordination compound is produced by complex formation:

$$K_1 \text{to } K_n \leqq Kr < Kz \quad (III)$$

The recording material may comprise as the coordination compounds a coordination compound with an 8-hydroxyquinoline derivative being contained as a ligand thereof, and a coordination compound comprising ferric iron. The coordination compound with an 8-hydroxy-quinoline derivative being contained as a ligand thereof may be a coordination compound with a 8-hydroxyquinoline derivative and an organic carboxylic acid being contained as ligands thereof. The coordination compound with at least an 8-hydroxyquinoline derivative being contained as a ligand thereof may further comprise magnesium.

The coordination compound having a stability Kr may be an electrolyte compound comprising zinc or nickel.

One of the coordination compounds may be an iron salt of an organic phosphoric acid, or an iron salt of a dicarboxylic acid.

The recording material may further comprise a dicarboxylic acid.

DESCRIPTION OF THE PREFERRED EMBODIMENTS

The recording material according to the present invention comprises at least two coordination compounds which can react to produce at least one newly produced coordination compound with the occurrence of visual changes in the recording material, and such visual changes are utilized for recording in the recording material.

More specifically, in the recording material of the present invention, two or more coordination compounds are held on an identical support or on different supports of the recording material, and recording energy such as heat, pressure, or electric energy is applied thereto, whereby an exchange reaction is caused to take place between the coordination compounds with respect to ligands and metal ions thereof to carry out the formation of a new coordination compound, which is accompanied by visual changes in the recording material, and such visual changes are utilized for recording.

At least one of the coordination compounds for use in the present invention is a coordination compound which comprises a fatty acid, an aromatic carboxylic acid, a heterocyclic carboxylic acid, an organic phosphoric acid or an organic sulfur acid, each of which may have a substituent, and a metal which is capable of forming a colored coordination compound in combination with a coordination compound (B) which will be described later. Hereinafter, such a coordination compound will be referred to as a coordination compound (A).

Specific examples of the coordination compound (A) include salts formed by one or more metals selected from the group consisting of iron, silver, copper, and cadmium and an acid selected from the group consisting of lauric acid, myristic acid, palmitic acid, margaric acid, stearic acid, behenic acid, glutaric acid, adipic acid, pimelic acid, suberic acid, azelaic acid, sebacic acid, dodecanedioic acid, eicosanedioic acid, benzoic acid, naphthoic acid, picolinic acid, nicotinic acid, isonicotinic acid, quinolinecarboxylic acid, 2,6-pyridylcarboxylic acid, phenylphosphoric acid, phenylphosphonic acid, phenylphosphlnic acid, phenyl phosphonous acid, diphenyl phosphate, dibenzyl phosphate, methyl phosphate, ethyl phosphate, dodecyl phosphate, bis [4-(methoxycarbonyl)phenyl]phosphoric acid, 1-naphthylphosphoric acid, stearylphosphonic acid, phytic acid, dodecylsulfuric acid, undecylsulfuric acid and hexadecyl sulfuric acid.

In the present invention, it is also possible to employ as the coordination compound (A) double metal salts of fatty acids, aromatic carboxylic acids, heterocyclic carboxylic acids, phosphoric acid and organic sulfur acids. By use of these double metal salts, it is possible to reduce the coloring of the background.

These double metal salts can be synthesized by allowing alkali metal salts or ammonium salts of the previously mentioned organic acids to react with inorganic metal salts of iron, silver, copper or cadmium, together with inorganic salts of metals other than alkali metals such as zinc, calcium, magnesium, aluminum, and barium. The content ratio of the respective metal ions in the double metal salts can be adjusted by adjusting the molar ratios of the metals added when synthesizing the double metal salts.

In the present invention, it is preferable that an organic phosphoric iron salt be employed as the coordination compound (A) in order to reduce the coloring of the background.

Furthermore, when a coordination compound comprising a dicarboxylic acid and ferric iron is employed, the reliability of reducing the coloring of the background is further improved. In particular, such coordination compounds have high melting points, so that the thermal stability of the background is further improved.

Furthermore, it is preferable that at least one of the coordination compounds be a coordination compound with a center metal selected from the group consisting of nickel, calcium, magnesium and barium and a ligand selected from the group consisting of a nitrogen ligand, an oxygen ligand, an oxygen nitrogen ligand, and a sulfur ligand. Such a coordination compound is hereinafter referred to as the coordination compound (B).

Examples of a nitrogen ligand include aliphatic amines which may have a substituent, aromatic amines, nitrogen-containing heterocyclic compounds, Schiff bases, porhyrin, pyrene; examples of an oxygen ligand are aliphatic diols which may have a substituent, dicarbonyl compounds, aromatic polyhydroxy compounds, hydroxy-carbonyl compounds, and hydroxyquinoline compounds; examples of a nitrogen oxygen ligand include amino-alcohol, aminophenol, aminoketone, aminopolycarboxylic acid, heterocyclic compounds, and oxime compounds; and examples of a sulfur ligand include dithiol compounds.

Specific examples of such a coordination compound (B) include zinc, calcium, magnesium, barium and aluminum salts of resorcin, t-butylcatechol, 2,3-dihydroxybenzoic acid, 3,4-dihydroxybenzoic acid, 2,3-dihydroxynaphthalene, hydroxynaphthoic acid, gallic acid, methyl gallate, ethyl gallate, propyl gallate, butyl gallate, dodecyl gallate, lauryl gallate, stearyl gallate, tannic acid, protocate-chuic acid, 8-hydroxyquinoline, 2-methyl-8-hydroxy-quinoline, 7-n-propyl-8-hydroxyquinoline, 5-amino-8-hydroxyquinoline, 6-chloro-8-hydroxyquinoline, 7-chloro-8-hydroxyquinoline, 5,7-dichloro-8-hydroxyquinoline, 6-bromo-8-hydroxyquinoline, 7-bromo-8-hydroxyquinoline, 5,7-dibromo-8-hydroxyquinoline, 5-iodo-8-hydroxy-quinoline, 6,7-diiodo-8-hydroxyquinoline, 7-bromo-5-chloro-8-hydroxyquinole, 5-bromo-7-chloro-8-hydroxy-quinoline, 5-amino-8-hydroxyquinoline, 5-fluoro-8-hydroxyquinoline, 7-dihalo-8-hydroxyquinoline, methylenebis(8-hydroxyquinoline), 2,2'-bipyridine, 1,10-phenanthoroline, bathocuproine, neocuproine, toluene-3,4-dithiol, dibenzoylacetone, hexamethylenetetramine and spirobenzopyrane, but are not limited to these examples.

In the present invention, as such a coordination compound (B)-, coordination compounds having two or more ligands can be employed. In particular, by use of a coordination compound having an 8-hydroxyquinoline derivative and an organic carboxylic acid as ligands thereof, the coloring of the background of the recording material of the present invention can be reduced. Furthermore, it is preferable that the center metal of these coordination compounds be selected from the group consisting of magnesium, zinc, nickel, calcium, barium, beryllium and aluminum.

It is preferable that at least one of such coordination compounds be contained as the coordination compound (B) in the recording material.

In the present invention, it is preferable to contain an acid material together with the above-mentioned at least two coordination compounds in order to improve the coloring performance of recorded images and to reduce the coloring of the background thereof.

Preferable examples of such an acid material for use in the present invention are carboxylic acid compounds, phenolic compounds and sulfonic acid compounds.

Specific examples of the carboxylic acid compounds include lauric acid, myristic acid, palmitic acid, stearic acid, 12-hydroxystearic acid, oxalic acid, malonic acid, succinic acid, glutaric acid, adipic acid, pimelic acid, suberic acid, azelaic acid, sebacic acid, acrylic acid, propiolic acid, methacrylic acid, crotonic acid, isocrotonic acid, oleic acid, maleic acid, fumaric acid, benzoic acid, toluylic acid, isopropylbenzoic acid, dimethylbenzoic acid, trimethylbenzoic acid, phthalic acid, isophthalic acid, terephthalic acid, 5-chloroisophthalic acid, benzenetricarboxylic acid, benzenetetracarboxylic acid, benzenepentacarboxylic acid, benzenehexacarboxylic acid, monoethyl phthalate, fluorobenzoic acid, dichlorobenzoic acid, bromophthalic acid, nitrobenzoic acid, dinitrobenzoic acid, trinitro-benzoic acid, nitroisophthalic acid, phenoxybenzoto acid, benzoylbenzoic acid, 4,4'-carbonyldibenzoic acid, mercaptobenzoic acid, methylthiobenzoic acid, aminobenzoic acid, phthalamic acid, phenylacetic acid, phenylpropionic acid, phenylbutyric acid, dihydroxyphenylbutyric acid, 2,3-dibromo-3-phenylpropionic acid, mandelic acid, 2,3-epoxy-3-phenylpropionic acid, phenylsuccinic acid, 1,2-benzenediacetic acid, atropic acid, cinnamic acid, β-methylcinnamic acid, 5-phenyl-2,4-pentadienoic acid, chlorocinnamic acid, methoxycoumaric acid, phenylglyoxylic acid, benzoylacetic acid, carbanilic acid, dihydroxybenzoic acid, gallic acid, naphthoic acid, hydroxynaphthoic acid, nicotinic acid, isonicotinic acid, furoic acid and thenoic acid.

Specific examples of the phenolic compounds include 4,4'-isopropylidenebisphenol, 4,4-diphenolsulfone, 4-isopropoxy-4'-hydroxydiphenylsulfone, 4-benzyloxy-4'-hydroxydiphenylsulfone, bis(4-hydroxy-3-allylphenyl)-sulfone, benzyl 4-hydroxybenzoate, methyl bis(4-hydroxyphenyl)-acetate, benzyl bis(4-hydroxyphenyl)-acetate, bis(4-hydroxy-3-methylphenyl)sulfide, 4,7-bis(4-hydroxyphenylthio)-3,5-dioxaheptane, 3,4-dihydroxy-4'-methylsulfone, 2,4'-diphenolsulfone, 1,5-bis(4-hydroxyphenylthio)-3-oxa-pentane, 1,3-bis(4-hydroxycumyl)benzene, benzyl protocatechuate, 1,3-bis(4-hydroxyphenylthio)propane, and 1,3-bis(4-hydroxyphenylthio)dihydroxypropane.

As the sulfonic acid derivatives, sulfonic acid derivatives with a thermal decomposition temperature of 60° C. or more are preferable for use in the present invention. Such sulfonic acid derivatives work as acid materials when heated to a temperature above the above-mentioned thermal decomposition temperature.

When other acid materials are employed in combination with such a sulfonic acid derivative, the thermal decomposition reaction is promoted and the coloring performance of the recording material is further improved.

Specific examples of such a sulfonic acid derivative include ester compounds of an organic sulfonic acid and an alcohol, Examples of such an organic sulfonic acid include benzenesulfonic acid, p-toluenesulfonic acid, 4-bromobenzenesulfonic acid, 4-methoxybenzenesulfonic acid, 4-benzyloxybenzenesulfonic acid, β-naphthalenesulfonic acid, 1,3-benzenedisulfonic acid, methanesulfonic acid, ethanesulfonic acid, 2-nitrobenzenesulfonic acid, 3-nitrobenzenesulfonic acid and 4-nitrobenzenesulfonic acid. Examples of such an alcohol include methanol, ethanol, propanol, isopropanol, 2-phenylethanol, 1-phenylpropanol, butanol, isobutanol, sec-butanol, tert-butanol, amyl alcohol, cyclohexanol, 2-methylcyclohexanol, 4-methylcyclohexanol, 4-tert-butylcyclohexanol, 2-cyclohexylcyclohexanol, 4-cyclohexylcyclohexanol 2,6-dimethylohexanol, benzhydrol, 1-phenylethanol, 2,3-dihydroindene-2-ol, 2-phenyl-1,3-dioxane-5-ol, ethylene glycol, diethylene glycol, propylene glycol, 2,2-dimethyl-1,3-propanediol, 1,4-butanediol, 2,3-butanediol, 2,5-hexanediol, 1,2-cyclohexanediol, 1,3-cyclohexanediol, 1,4-cyclohexanediol, 2,2-bis(4-cyclohexyl)propane.

Specific examples of the sulfonic acid ester compounds are as follows:

cyclohexyl-p-toluenesulfonate,
cyclohexylbenzenesulfonate,
cyclohexyl-o-nitrobenzenesulfonate,
cyclohexyl-m-nitrobenzenesulfonate,
cyclohexyl-p-nitrobenzenesulfonate,
cyclohexyl-β-naphthalenesulfonate,
cyclohexylmethanesulfonate,
2-methylcyclohexyl-p-toluenesulfonate,
2-methylcyclohexylbenzenesulfonate,
2-methylcyclohexyl-o-nitrobenzenesulfonate,
2-methylcyclohexyl-m-nitrobenzenesulfonate,
2-methylcyclohexyl-p-nitrobenzenesulfonate,
2-methylcyclohexyl-β-naphthalenesulfonate,
2-methylcyclohexylmethanesulfonate,
2-cyclohexylcyclohexyl-p-toluenesulfonate,
2-cyclohexyl-cyclohexylbenzenesulfonate,
2-cyclohexylcyclohexyl-o-nitrobenzenesulfonate,
2-cyclohexylcyclohexyl-m-nitrobenzenesulfonate,
2-cyclohexylcyclohexyl-p-nitrobenzenesulfonate,
2-cyclohexylcyclohexyl-β-naphthalenesulfonate,
2-cyclohexylcyclohexylmethane-sulfonate,
4-tert-butylcyclohexyl-p-toluenesulfonate,
4-tert-butylcyclohexyl benezenesulfonate,
4-tert-butylcyclohexyl-o-nitrobenzenesulfonate,
4-tert-butylcyclohexyl-m-nitrobenzenesulfonate,
4-tert-butylcyclohexyl-p-nitrobenzenesulfonate,
4-tert-butylcyclohexyl-β-naphthalenesulfonate,
4-tert-butylcyclohexylmethanesulfonate,
1,3-cyclohexylenebis(p-toluenesulfonate),
1,3-cyclohexylenebis(benzenesulfonate),
1,3-cyclohexylenebis(o-nitrobenzenesulfonate),
1,3-cyclohexylenebis(m-nitrobenzenesulfonate),
1,3-cyclohexylenebis(p-nitrobenzenesulfonate),
1,3-cyclohexylenebis(β-naphthalenesulfonate),
1,3-cyclohexylenebis(methanesulfonate),
1,4-cyclohexylenebis(p-toluenesulfonate),
1,4-cyclohexylenebis(benzenesulfonate).
1,4-cyclohexylenebis(o-nitrobenzenesulfonate),
1,4-cyclohexylenebis(m-nitrobenzenesulfonate),
1,4-cyclohexylenebis(p-nitrobenzenesulfonate),
1,4-cyclohexylenebis(β-naphthalenesulfonate),
1,4-cyclohexylenebis(methanesulfonate),
2,3-butylenebis(p-toluenesulfonate),
2,3-butylenebis(benzenesulfonate),
2,3-butylenebis(o-nitrobenzenesulfonate),
2,3-butylenebis(m-nitrobenzenesulfonate),
2,3-butylenebis(p-nitrobenzenesulfonate),
2,3-butylenebis(β-niphthalenesulfonate),
2,3-butylenebis(methanesulfonate),
diphenylmethane-p-toluenesulfonate,
diphenylmethanebenzenesulfonate,
diphenylmethane-o-nitrobenzenesulfonate,
diphenylmethane-m-nitrobenzenesulfonate,
diphenylmethane-p-nitrobenzenesulfonate,
diphenylmethane-β-naphthalenesulfonate,
1-phenylethyl-p-toluenesulfonate,
1-phenylethylbenzenesulfonate,
1-phenylethyl-o-nitrobenzenesulfonate,
1-phenylethyl-m-nitrobenzenesulfonate,
1-phenylethyl-p-nitrobenzenesulfonate,
1-phenylethyl-β-naphthalenesulfonate,
1-phenylethylmethanesulfonate,
4-cyclohexylcyclohexylbenzenesulfonate,
2-phenyl-1,3-dioxan-5-ylbenzenesulfonate, and
2,3-dihydroinden-2-ylbenzenesulfonate.

In the present invention, when a water-releasing material is used in combination with the previously mentioned at least two coordination compounds, the coloring performance of the recording material is further improved, and when an acid material is also used in combination with the above, the stability of images obtained is further improved.

It is considered that the water-releasing material to be used in combination with the two or more coordination compounds has the function of providing a reaction field for promoting a metal exchange reaction between the two or more coordination compounds. Therefore as the water-releasing material for use in the present invention, any materials can be used without particular restriction as long as they can release water when thermal energy such as heat is applied thereto.

Examples of such a water-releasing material include compounds with crystal water, polymeric absorbing materials, microcapsuled materials in which water is microcapsuled, or a water-containing material is microcapsuled.

Specific examples of compounds with crystal water for use In the present invention include:

$Al(BrO_3)_3.9H_2O$, $Al_2O_3.3CaO.3H_2O$, $Al(ClO_3)_3.6H_2O$, $Al(NO_3)_3.9H_2O$, $Al_2O_3.H_2O$, $Al(ClO_4)_3.6H_2O$, $NH_4[Au(Cn)_4].H_2O$,
$BeNH_4PO_4.H_2O$, $Cd(NH_4)_2(SO_4)_2.6H_2O$, $CaNH_4PO_4.7H_2O$,
$(NH_4)_2[Ce(NO_3)_5].4H_2O$, $(NH_4)_2[Ce(SO_4)_4]_2.8H_2O$,
$Cu(NH_4)_2Cl_4.2H_O$, $(NH_4)_2S_2O_6.O.5H_2O$, $NH_4HC_2O_4.H_2O$,
$MgNH_4Cl_3.6H_2O$, $MgNH_4PO_4.6H_2O$, $Mg(NH_4)_2(SO_4)_2.6H_2O$,
$(NH_4)_6Mo_7O_{24}.4H_2O$, $(NH_4)_2C_2O_4.H_2O$, $NaNH_4HPO_4.H_2O$, $NaNH_4SO_4.2H_2O$,
$Ba(C_2H_3O_2)_2.H_2O$, $Ba(BrO_3)_2.H_2O$, $BaBr_2.H_2O$, $Ba(ClO_3)_2.H_2O$,
$BaCl_2.2H_2O$, $Ba_3(C_6H_5O_7)_2.7H_2O$, $Ba(IO_3)_2.H_2O$, $Be_3(PO_4)_2.3H_2O$,
$BeSeO_4.4H_2O$, $BeSO_4.4H_2O$, $Bi(NO_3)O.H_2O$, $Cd(C_2H_3O_2)_2.2H_2O$,
$CdSeO_4.2H_2O$, $Ca(C_7H_5O_2)_2.3H_2O$, $Ca(BrO_3)_2.H_2O$, $Ca(ClO_3)_22H_2O$,
$CaCrO_4.2H_2O$, $Ca(C_6H_6O_7).4H_2O$, $CaHPO_4.2H_2O$, $Ca(H_2PO_4)_2.H_2O$,
$Ca(C_3H_5O_3)_2.5H_2O$, $CaC_2O_4.H_2O$, $CaO_2.8H_2O$, $Ca(C_7H_5O_3)_2.2H_2O$,
$CaSO_4.O.5H_2O$, $CaSO_4.2H_2O$, $CaSO_3.2H_2O$, $CaC_4H_4O_6.4H_2O$,
$CaC_4H_4O_6.4H_2O$, $CaC_4H_4O_6.3H_2O$, $Ce(NO_3)_3.6H_2O$, $Co(C_2H_3O_2)_2.4H_2O$,
$COBr.6H_2O$, $CoCl_2.6H_2O$, $Co_3(PO_4)_2.8H_2O$, $Co(SCN)_2.3H_2O$,
$CuCl_2.2H_2O$, $2Cu_2C_6H_4O_7.5H_2O$, $Cu(CHO_2)_2.4H_2O$, $Cu(CHO_2)_2.4H_2O$,
$CuSeO_4.5H_2O$, $CuSo_4.5H_2O$, $FePO_4.2H_2O$, $Pb(BO_2)_2.H_2O$,
$Pb(C_6H_2N_3O_7)_2.2H_2O$, $Li_2CrO_4.2H_2O$, $Li_3C_6H_5O_7.4H_2O$, $LiCHO_2.H_2O$,
$Li_2SO_4.H_2O$, $Mg(BrO_3)_2.6H_2O$, $MgCO_3.3H_2O$, $Mg(CHO_2)_2.2H_2O$,
$MgHPO_4.7H_2O$, $Mg_3(PO_4)_2.5H_2O$, $Mg_3(PO_4)_2.8H_2O$, $Mg(PH_2O_2)_2.6H_2O$,
$MgC_4H_4O_6.5H_2O$, $Mn(SCN)_2.3H_2O$, $NiBr_2.3H_2O$, $Ni(CHO_2)_2.2H_2O$,
$K_4P_2O_7.3H_2O$, $K_4[Fe(CN)_6].3H_2O$, $K_2[Ni(CN)_4].H_2O$, $KnaCO_3.6H_2O$,
$K_2C_4H_4O_6.5H_2O$, $Na_2CO_3.H_2O$, $C_6H_5O_7Na_3.2H_2O$, $Na_2S_2O_6.2H_2O$,
$Na_2H_2P_2O_6.6H_2O$, $NaH_2PO_4.H_2O$, $NaPH_2O_2.H_2O$, $Na_2C_4H_4O_6.2H_2O$,
$Na_2S_2O_3.5H_2O$, $Zn(HCO_2)_2.2H_2O$, and $ZnSO_4.7H_2O$, but are not limited to these compounds.

It is preferable that the water-releasing material have a melting point or water-releasing temperature of 60° C. or more for use in the present invention.

When the compound with crystal water is an alum derivative of the following formula (I) or (II), the coloring performance of the recording material is significantly improved:

$$M^1M^3(SO_4)_2.12H_2O \quad (I)$$

$$M^1{}_2SO_4.M^3{}_2(SO_4)_3.24H_2O \quad (II)$$

wherein $M^1$ is a monovalent metal, ammonium, or an alkyl ammonium; and $M^3$ is a trivalent metal.

Specific compounds of the above formula (I) or (II) are as follows, but are not limited to these examples:

$AlNH_4(SO_4)_2.12H_2O$, $AlCs(SO_4)_2.12H_2O$, $Alk(SO_4)_2.12H_2O$,
$AlRb(SO_4)_2.12H_2O$, $AlNa(SO_4)_2.12H_2O$, $AlTl(SO_4)_2.12H_2O$,
$GaNH_4(SO_4)_2.12H_2O$, $CsGa(SO_4)_2.12H_2O$, $GaK(SO_4)_2.12H_2O$,
$CrNH_4(SO_4)_2.12H_2O$, $FeNH(SO_4)_2.12H_2O$, $NH_4V(SO_4)_2.12H_2O$,
$CsFe(SO_4)_2.12H_2O$, $CrK(SO_4)_2.12H_2O$, $KV(SO_4)_2.12H_2O$, and $RbV(SO_4)_2.12H_2O$.

In particular, in the compounds of formula (I) or (II), compounds with $M^3$ being Al are colorless or light-colored and have the function of reducing the coloring of the background, so that such compounds are preferable for use in the present invention.

The recording material according to the present invention can be fabricated in such a layered structure that a thermosensitive coloring layer comprising two or more coordination compounds and a layer comprising the above-mentioned water-releasing material are overlaid on a support.

There may a case where the compound of formula (I) or (II) is caused to coagulate and separated when mixed with a binder agent such as polyvinyl alcohol. In such a case, the amount of the compound of formula (I) or (II) to be used will have to be limited appropriately. In such a case, the coagulation of the compound of formula (I) or (II) can be prevented by use of polysaccharide as the binder agent. As such polysaccharide, pullulan is particularly preferable for use in the present invention. When pullulan is employed, the limitation to the addition amount is significantly reduced and the control of the coloring performance becomes easy.

Furthermore, according to the present invention, when the two or more coordination compounds have stabilities $K_1$ to $K_n$, and a coordination compound newly produced by those coordination compounds has a stability Kz, if a compound comprising a metal which is capable of forming a coordination compound having a stability Kr which satisfies the following formula (III) is employed, a recording material which has excellent background stability to changes in the ambient temperature and humidity and is free from initial background fogging and with-time background fogging can be obtained while excellent coloring performance is maintained:

$$K_1 \text{ to } K_n \leqq Kr < Kz \quad (III)$$

In the present invention, the compound which contain a metal which satisfies the conditions of the above-mentioned formula (III) is specifically a compound comprising a metal, which is capable of forming a coordination compound (R) having a higher stability than that of any of the coordination compound (A) or the coordination compound (B), and a lower stability than that of a coordination compound newly produced from the coordination compound (A) and the coordination compound (B).

The stability mentioned here means the stability of the coordination compound in a solution thereof.

Furthermore, when the metal ion is M, the ligand thereof is L, and the coordination compound formed by complex formation from these metal ion M and the ligand L is MLn, and the stability of the coordination compound MLn is K, the stability K is represented by the following formula (IV):

$$K=[MLn]/[M][L]^n$$

wherein n is the number of ligands L which are coordinated to the metal ion M, [M], [L] and [MLn] are the respective concentrations of M, L and MLn in the solution thereof.

Many methods of measuring the stability of coordination compound have been studied and reported, for instance, in Bunseki Kagaku Taikei (Encyclopedia of Chemical Analysis), Complex Formation Reactions, edited by Nippon Bunseki Kagaku Kai, 1974, and Chelate Chemistry (6), Experimental Methods in Complex Chemistry (III) (edited by Kagehira Ueno, published by Nan-undo Co., Ltd., 1975).

Furthermore, stability constants of many coordination compounds are described in "Stability Constants of Metalton Complexes" The Chemical Society (LONDON) Special Publication No.17 (1964), No.25 (1971)., A. E. Martell and R. M. Smith, and "Critical Stability Constants", Vol. 1–4, Plenum Press (1974–1977). The data in these references can also be utilized.

Furthermore, of the compounds which satisfy the previously mentioned conditions for the metal, compounds which are electrolyte compounds are capable of releasing the metal ion efficiently because of large degree of dissociation, so that such electrolyte compounds are particularly preferable for use in the present invention.

A particularly preferable example of the recording material of the present invention will now be explained. In such a recording material of the present invention, a coordination compound containing at least an 8-hydroxyquinoline derivative as a ligand thereof, and a coordination compound containing ferric iron are used in combination. By use of these coordination compounds in combination, the recording sensitivity, and the preservation stability of recorded image areas and the background thereof can be significantly improved.

In particular, by use of a coordination compound comprising a magnesium salt of 8-hydroxyquinoline and ferric iron is employed, the above-mentioned effects are significantly intensified.

Furthermore, by the addition of a compound which contains zinc ton or nickel ion, which provides a higher stability than that of the magnesium salt of 8-hydroxyquinoline and a lower stability than that of a ferric iron salt of 8-hydroxyquinoline, the preservation stability of the background of the recording material is furthermore improved.

In order to have the effects of the present invention exhibited sufficiently, when a thermosensitive coloring layer comprises as main components a coordination compound comprising a magnesium salt of an 8-hydroxyquinoline derivative and ferric iron, and an electrolyte compound zinc or nickel is formed on a support by applying a coating liquid for the formation of the thermosensitive coloring layer, its preferable that the mixing order of such main components be in such an order that an aqueous solution of the electrolyte comprising zinc or nickel comes first, and the magnesium salt of the 8-hydroxyquinoline derivative and ferric iron is then mixed with the aqueous solution.

For fabricating a thermosensitive recording material which is an application example of the recording material of the present invention, a dispersion liquid which contains the previously mentioned two or more coordination compounds, with the addition of one or more of an acid component and/or a compound comprising the metal which satisfies the conditions of the previously mentioned formula (III), and other auxiliary agents, or a solution of the above-mentioned components, is coated on a support, and the coated dispersion liquid or solution is dried, whereby a thermosensitive coloring layer is formed on the support. Thus, a thermosensitive recording material is fabricated.

Furthermore, a layer comprising the previously mentioned water-releasing material may also be provided separately from the thermosensitive recording layer.

The above-mentioned "other auxiliary agents" mean agents which are employed in conventional thermosensitive recording materials, for example, fillers, surface active agents, lubricants, and pressure-coloring preventing agents.

The layered structure of the recording material of the present invention may be either a single-layer structure or a multiple layered structure, and when necessary, an overcoat layer, an undercoat layer or a backcoat layer may be additionally provided.

Other features of this invention will become apparent in the course of the following description of exemplary embodiments, which are given for illustration of the invention and are not intended to be limiting thereof.

Preparation of Liquids A to L:

Liquids A to L were prepared by dispersing the respective components as shown below in a magnetic ball mill for 2 days:

| | Parts by Weight |
|---|---|
| [Liquid A] | |
| Stearic acid-iron-calcium (Fe:Ca = 1:2) | 20 |
| 10% aqueous solution of polyvinyl alcohol | 20 |
| Water | 60 |
| [Liquid B] | |
| Diphenylphosphoric acid-iron | 20 |
| 10% aqueous solution of polyvinyl alcohol | 20 |
| Water | 60 |
| [Liquid C] | |
| Dodecanedioic acid-iron | 20 |
| 10% aqueous solution of polyvinyl alcohol | 20 |
| Water | 60 |
| [Liquid D] | |
| 2,3-dihydroxynaphthalene-zinc | 20 |
| 10% aqueous solution of polyvinyl alcohol | 20 |
| Water | 60 |
| [Liquid E] | |
| 8-hydroxyquinoline-zinc | 20 |
| 10% aqueous solution of polyvinyl alcohol | 20 |
| Water | 60 |
| [Liquid F] | |
| 8-hydroxyquinoline-magnesium | 20 |
| Polyvinyl alcohol | 20 |
| Water | 60 |
| [Liquid G] | |
| 8-hydroxyquinoline-benzoic acid-magnesium | 20 |
| 10% aqueous solution of polyvinyl alcohol | 20 |
| Water | 60 |
| [Liquid H] | |
| 2,4-dinitrobenzoic acid | 20 |
| Polyvinyl acid | 20 |
| Water | 60 |

-continued

| | Parts by Weight |
|---|---|
| [Liquid I] | |
| 1,5-bis(4-hydroxyphenylthio)-3-oxa-pentane | 20 |
| 10% aqueous solution of polyvinyl alcohol | 20 |
| Water | 60 |
| [Liquid J] | |
| 2-cyclohexylcyclohexyl-m-nitrobenzenesulfonate | 20 |
| Polyvinyl alcohol | 20 |
| Water | 60 |
| [Liquid K] | |
| Dodecanedioic acid | 20 |
| 10% aqueous solution of polyvinyl alcohol | 20 |
| Water | 60 |
| [Liquid L] | |
| Calcium carbonate | 20 |
| Methyl cellulose | 20 |
| Water | 60 |
| [Liquid M] was prepared by dissolving 1 g of barium chloride dihydrate in 20 g of water. | |
| [Liquid N] was prepared by dissolving 1 g of aluminum ammonium sulfate in 20 g of water. | |
| [Liquid O] was prepared by dissolving 13 g of nickel chloride in 577 g of water. | |
| [Liquid P] was prepared by dissolving 14 g of zinc chloride in 640 g of water. | |

EXAMPLE 1

24 parts by weight of [Liquid A], 16 parts by weight of [Liquid D], and 10 parts by weight of [Liquid L] were mixed in this order to prepare a thermosensitive coloring layer formation liquid.

The thus prepared thermosensitive coloring layer formation liquid was coated on a sheet of high quality paper, dried at room temperature, and calendered, whereby a thermosensitive recording sheet No. 1 of the present invention was prepared.

EXAMPLE 2

The procedure for preparation of the thermosensitive recording sheet No. 1 in Example 1 was repeated except that [Liquid D] in the formulation of the thermosensitive coloring layer formation included in Example 1 was replaced with [Liquid E], whereby a thermosensitive recording sheet No. 2 of the present Invention was prepared.

EXAMPLE 3

The procedure for preparation of the thermosensitive recording sheet No. 1 in Example 1 was repeated except that [Liquid D] in the formulation of the thermosensitive coloring layer formation liquid in Example 1 was replaced with [Liquid F], whereby a thermosensitive recording sheet No. 3 of the present invention was prepared.

EXAMPLE 4

The procedure for preparation of the thermosensitive recording sheet No. 1 in Example 1 was repeated except that [Liquid D] in the formulation of the thermosensitive coloring layer formation liquid in Example 1 was replaced by [Liquid G], whereby a thermosensitive recording sheet No. 4 of the present invention was prepared.

EXAMPLE 5

The procedure for preparation of the thermosensitive recording sheet No. 1 in Example 1 was repeated except that [Liquid A] in the formulation of the thermosensitive coloring layer formation included in Example 1 was replaced by [Liquid B], whereby a thermosensitive recording sheet No. 5 of the present invention was prepared.

EXAMPLE 6

The procedure for preparation of the thermosensitive recording sheet No. 3 in Example 3 was repeated except that 10 parts by weight of [Liquid H] was added to the formulation of the thermosensitive coloring layer formation liquid in Example 3, whereby a thermosensitive recording sheet No. 6 of the present invention was prepared.

EXAMPLE 7

The procedure for preparation of the thermosensitive recording sheet No. 3 in Example 3 was repeated except that 10 parts by weight of [Liquid J] was added to the formulation of the thermosensitive coloring layer formation liquid in Example 3, whereby a thermosensitive recording sheet No. 7 of the present invention was prepared.

EXAMPLE 8

The procedure for preparation of the thermosensitive recording sheet No. 3 in Example 3 was repeated except that 5 parts by weight of [Liquid I] was added to the formulation of the thermosensitive coloring layer formation liquid in Example 3, whereby a thermosensitive recording sheet No. 8 of the present invention was prepared.

EXAMPLE 9

The procedure for preparation of the thermosensitive recording sheet No. 7 in Example 7 was repeated except that 5 parts by weight of [Liquid M] was added to the formulation of the thermosensitive coloring layer formation liquid in Example 7, whereby a thermosensitive recording sheet No. 9 of the present invention was prepared.

EXAMPLE 9

The procedure for preparation of the thermosensitive recording sheet No. 7 in Example 7 was repeated except that 5 parts by weight of [Liquid N] was added to the formulation of the thermosensitive coloring layer formation liquid in Example 7, whereby a thermosensitive recording sheet No. 10 of the present invention was prepared.

EXAMPLE 10

8 parts by weight of aluminum ammonium sulfate.$12H_2O$ was dissolved in 92 g of a 7% aqueous solution of pullulan to prepare a water-releasing material coating liquid.

The thus prepared water-releasing material coating liquid was coated on a sheet of high quality paper with an aluminum ammonium sulfate.12HiO deposition amount of 3 g/$m^2$ on a dry basis, and dried at room temperature.

On the water-releasing material coating liquid coated surface of the high quality paper sheet, the thermosensitive coloring layer formation liquid prepared in Example 7 was coated, and dried at room temperature, whereby a thermosensitive coloring layer was formed.

The thus formed thermosensitive coloring layer was then calendered, whereby a thermosensitive recording sheet No. 11 of the present invention was prepared.

EXAMPLE 12

24 parts by weight of [Liquid A], 16 parts by weight of [Liquid E], 10 parts by weight of [Liquid L] and one part by weight of [Liquid O] were mixed in the order of [Liquid O], [Liquid E], [Liquid L] and [Liquid A] to prepare a thermosensitive coloring layer formation liquid.

The thus prepared thermosensitive coloring layer formation liquid was coated on a sheet of high quality paper, dried at room temperature, and calendered, whereby a thermosensitive recording sheet No. 12 of the present invention was prepared.

EXAMPLE 13

The procedure for preparation of the thermosensitive recording sheet No. 12 in Example 12 was repeated except that [Liquid E] and [Liquid O] in the formulation of the thermosensitive coloring layer formation liquid in Example 12 were respectively replaced by [Liquid F] and [Liquid P], whereby a thermosensitive recording sheet No. 13 of the present invention was prepared.

EXAMPLE 14

The procedure for preparation of the thermosensitive recording sheet No. 13 was repeated except that the thermosensitive coloring layer formation liquid prepared In Example 13 was coated on the high quality paper sheet coated with the water-releasing material prepared in Example 11, whereby a thermosensitive recording sheet No. 14 of the present invention was prepared.

EXAMPLE 15

The procedure for preparation of the thermosensitive recording sheet No. 14 in Example 14 was repeated except that [Liquid A] in the formulation of the thermosensitive coloring layer formation liquid in Example 14 was replaced by [Liquid C], whereby a thermosensitive recording sheet No. 15 of the present invention was prepared.

EXAMPLE 16

The procedure for preparation of the thermosensitive recording sheet No. 15 in Example 15 was repeated except that 10 parts by weight of [Liquid K] were finally added to the thermosensitive coloring layer formation liquid in Example 15, whereby a thermosensitive recording sheet No. 6 of the present invention was prepared.

Comparative Example 1

[Liquid Q] and [Liquid R] were prepared by dispersing the respective components as shown below in a magnetic ball mill for 2 days:

| | Parts by Weight |
|---|---|
| [Liquid Q] | |
| 3-dibutylamino-6-methyl-7-anilinofluorane | 20 |
| 10% aqueous solution of polyvinyl alcohol | 20 |
| Water | 60 |

-continued

| | Parts by Weight |
|---|---|
| [Liquid R] | |
| Bisphenol A | 20 |
| 10% aqueous solution of polyvinyl alcohol | 20 |
| Water | 60 |

The procedure for preparation of the thermosensitive recording sheet No. 1 in Example 1 was repeated except that 40 parts by weight of [Liquid A] and 40 parts by weight of [Liquid B] in the formulation of the thermosensitive coloring layer formation liquid in Example 1 were respectively replaced by 20 parts by weight of [Liquid Q] and 60 parts by weight of [Liquid R], whereby a comparative thermosensitive recording sheet No. 1 was prepared.

Comparative Example 2

[Liquid S] and [Liquid T] were prepared by dispersing the respective components as shown below in a magnetic ball mill for 2 days:

| | Parts by Weight |
|---|---|
| [Liquid S] | |
| Stearic acid-iron | 20 |
| 10% aqueous solution of polyvinyl alcohol | 20 |
| Water | 60 |
| [Liquid T] | |
| Stearyl gallate | 20 |
| 10% aqueous solution of polyvinyl alcohol | 20 |
| Water | 60 |

The procedure for preparation of the thermosensitive recording sheet No. 1 in Example 1 was repeated except that [Liquid A] and [Liquid B] in the formulation of the thermosensitive coloring layer formation liquid in Example 1 were respectively replaced by [Liquid S] and [Liquid T], whereby a comparative thermosensitive recording sheet No, 2 was prepared.

On the above prepared thermosensitive recording sheets Nos. 1–16 according to the present invention and comparative thermosensitive recording sheets Nos. 1–2, thermal printing was conducted by use of a commercially available thermal printing apparatus made by Matsushita Electric Parts Co., Ltd., under the conditions that the applied power was 0.68 w/dot, and a line period was 10 ms/line.

Reliability tests were conducted to each of the thus printed thermosensitive recording sheets, with respect to the resistance to plasticizer, resistance to high temperature and humidity, and heat resistance thereof.

A plasticizer resistance test was conducted by coating a plasticizer on the surface of each printed thermosensitive recording sheet by use of absorbent cotton to prepare a test sample, and allowing each test sample to stand at 40° C. in a dry atmosphere for 16 hours to inspect the image remaining ratio and the background density of the images after this test.

A high temperature and humidity resistance test was conducted by allowing each test sample to stand at 40° C./90% for 16 hours to inspect the image remaining ratio and the background density of the images after this test.

A heat resistance test was conducted by allowing each test sample to stand at 80° C. in a dry atmosphere for 16 hours to inspect the image remaining ratio and the background density of the images after this test.

The image density and background density of each test sample were measured by Mcbeth densitometer RD-914.

The results of the above tests are shown in TABLE 1, in which the data of the column of "images" indicate the image remaining ratio after the test, measured by reference to the colored image density after printing. Mark "O" denotes that the image remaining ratio was 95% or more; and mark "X" denotes that the image remaining ratio was less than 90%.

TABLE 1

| | Resistance to Plasticizers | | Resistance to High Temperature & Humidity | | Heat Resistance | | Initial | Coloring Performance | |
|---|---|---|---|---|---|---|---|---|---|
| | Images | Background Density | Images | Background Density | Images | Background Density | Background Density | 0.4 ms | 0.6 ms |
| Ex. 1 | O | 0.19 | O | 0.20 | O | 0.40 | 0.18 | 0.32 | 0.75 |
| Ex. 2 | O | 0.17 | O | 0.21 | O | 0.43 | 0.16 | 0.30 | 0.74 |
| Ex. 3 | O | 0.18 | O | 0.22 | O | 0.51 | 0.17 | 0.35 | 0.80 |
| Ex. 4 | O | 0.16 | O | 0.18 | O | 0.40 | 0.14 | 0.28 | 0.70 |
| Ex. 5 | O | 0.16 | O | 0.19 | O | 0.34 | 0.14 | 0.27 | 0.63 |
| Ex. 6 | O | 0.15 | O | 0.16 | O | 0.48 | 0.14 | 0.38 | 0.85 |
| Ex. 7 | O | 0.15 | O | 0.20 | O | 0.52 | 0.15 | 0.40 | 0.89 |
| Ex. 8 | O | 0.14 | O | 0.17 | O | 0.55 | 0.13 | 0.47 | 0.91 |
| Ex. 9 | O | 0.15 | O | 0.19 | O | 0.49 | 0.14 | 0.47 | 0.97 |
| Ex. 10 | O | 0.16 | O | 0.20 | O | 0.42 | 0.14 | 0.54 | 1.02 |
| Ex. 11 | O | 0.15 | O | 0.18 | O | 0.47 | 0.13 | 0.60 | 1.13 |
| Ex. 12 | O | 0.13 | O | 0.13 | O | 0.48 | 0.10 | 0.35 | 0.80 |
| Ex. 13 | O | 0.13 | O | 0.14 | O | 0.48 | 0.11 | 0.38 | 0.85 |
| Ex. 14 | O | 0.13 | O | 0.13 | O | 0.44 | 0.12 | 0.57 | 1.10 |
| Ex. 15 | O | 0.14 | O | 0.13 | O | 0.15 | 0.13 | 0.44 | 0.84 |
| Ex. 16 | O | 0.12 | O | 0.12 | O | 0.13 | 0.12 | 0.56 | 1.15 |
| Comp. Ex. 1 | X | 0.11 | O | 0.11 | O | 0.15 | 0.08 | 0.55 | 1.11 |
| Comp. Ex. 2 | O | 0.33 | O | 0.35 | O | 0.83 | 0.20 | 0.45 | 0.89 |

The test results shown in TABLE 1 indicate that the images in the sample of Comparative Example 1 were decolorized when subjected to the plasticizer resistance test. By contrast, none of the images in the samples of Examples 1 to 16 of the present invention was decolorized. In other words, the samples of Examples 1 to 16 of the present invention exhibited excellent image preservation stability.

In comparison with the sample of Comparative Example 2, the samples of Examples 1, 2, 3 and 5 have lower initial background densities and much better background preservability.

The results of Examples 6, 7 and 8 indicate that by the addition of the acid materials, the coloring performance thereof is improved with the good background preservation stability thereof being maintained.

The results of Examples 9, 10 and 11 indicate that by the addition of the water-releasing materials, the coloring performance thereof is further improved with the good background preservation stability thereof being maintained.

The results of Examples 12 and 13 indicate that by the addition of the inorganic compounds containing metals having particular stabilities, the initial background density is further improved, and the background preservation stability is also further improved.

The results of Examples 15 and 16 indicate that by the addition of the coordination compounds containing the dicarboxylic acid and iron, excellent background stability can be obtained and the heat resistant, background preservability can be further improved.

Japanese Patent Applications Nos. 5-283961 filed Oct. 18, 1993, 5-312553 filed Nov. 18, 1993, 5-344165 filed Dec. 18, 1993, 5-34674 filed Dec. 23, 1993, and Japanese Patent Application with the application number being not available yet, filed Oct. 14, 1994 are hereby incorporated by reference.

What is claimed is:

1. A composition for use in a recording material having a visual appearance comprising a substrate and one or more recording layers, wherein said composition is contained in said one or more recording layers, said composition comprising at least two coordination compounds (A) and (B) which react to produce at least one newly produced coordination compound with the occurrence of visual changes in said recording material, which visual changes are utilized for recording, said composition also comprising at least one additional compound, and wherein said coordination compound (A) comprises (1) a fatty acid, an aromatic carboxylic acid, a heterocyclic carboxylic acid, an organic phosphoric acid, or an organic sulfur acid and (2) one metal capable of forming a colored coordination compound with said coordination compound (B), alone or with an additional metal, and wherein said coordination compound (B) has a (1) center metal and (2) a ligand selected from the group consisting of nitrogen ligands, oxygen ligands, oxygen-nitrogen ligands and sulfur ligands, and wherein said at least one additional compound is selected from the group consisting of (a) a sulfonic acid ester with a thermal decomposition temperature of 60° C. or more, (b) a water-releasing material which is a compound of the formula (I) or (II):

$$M^1M^3(SO_4)_2.12H_2O \quad (I)$$

$$M^1{}_2SO_4.M^3{}_2(SO_4)_3.24H_2O \quad (II)$$

wherein $M^1$ is a monovalent metal, ammonium, or alkyl ammonium, and $M^1$ is a trivalent metal, and (c) a compound comprising a metal which is capable of forming a coordination compound having a stability Kr which satisfies formula (III) when said at least two coordination compounds have stabilities $K_1$ to $K_n$, and said at least one newly produced coordination compound has a stability Kz when said newly produced coordination compound is produced by complex formation:

$$K_1 \text{to } K_n \leqq Kr < Kz \quad \text{(III).}$$

2. The composition of claim 1 wherein said at least one additional compound is a sulfonic acid ester with a thermal decomposition temperature of 60° C. or more.

3. The composition of claim 1 wherein said at least one additional compound is a water-releasing material which is a compound of the formula (I) or (II):

$$M^1M^3(SO_4)_2.12H_2O \quad \text{(I)}$$

$$M^1{}_2SO_4.M^3{}_2(SO_4)_3.24H_2O \quad \text{(II)}$$

wherein $M^1$ is a monovalent metal, ammonium, or alkyl ammonium, and $M^3$ is a trivalent metal.

4. The composition of claim 3, further comprising pullulan, together with said water-releasing material.

5. The composition of claim 1 wherein said at least one additional compound is a compound comprising a metal which is capable of forming a coordination compound having a stability Kr which satisfies formula (III) when said at least two coordination compounds have stabilities $K_1$ to $K_n$, and said at least one newly produced coordination compound has a stability Kz when said newly produced coordination compound is produced by complex formation:

$$K_1 \text{to } K_n \leqq Kr < Kz \quad \text{(III)}$$

6. The composition of claim 1 wherein as said coordination compounds are contained a coordination compound with an 8-hydroxy-quinoline compound being contained as a ligand thereof, and a coordination compound comprising ferric ion.

7. The composition of claim 6, wherein said coordination compound with an 8-hydroxyquinoline, compound being contained as a ligand thereof is a coordination compound with a 8-hydroxyquinoline compound and an organic carboxylic acid being contained as ligands thereof.

8. The composition of claim 6, wherein said coordination compound with an 8-hydroxyquinoline compound being contained as a ligand thereof further comprises magnesium.

9. The composition of claim 7, wherein said coordination compound with at least an 8-hydroxyquinoline compound being contained as a ligand thereof further comprises magnesium.

10. The composition of claim 8, wherein said coordination compound having a stability Kr is an electrolyte compound comprising zinc or nickel.

11. The composition of 9, wherein said coordination compound having a stability Kr is an electrolyte compound comprising zinc or nickel.

12. The composition of claim 1, wherein one of said coordination compounds is an iron salt of an organic phosphoric acid.

13. The composition of claim 1, wherein one of said coordination compounds is an iron salt of a dicarboxylic acid.

14. The composition of claim 12, further comprising a dicarboxylic acid.

* * * * *

UNITED STATES PATENT AND TRADEMARK OFFICE

CERTIFICATE OF CORRECTION

PATENT NO. : 5,489,501

DATED : FEBRUARY 6, 1996

INVENTOR(S) : Torii et al.

It is certified that error appears in the above-identified patent and that said Letters Patent is hereby corrected as shown below:

On the Title Page at [30], the date of the fifth line priority cited,
"Oct. 14, 1994 [JP] Japan .....5-346474"
should read
"Dec. 23, 1993 [JP] Japan .....5-346474"

Column 1, line 36, "chelate according materials recording materials" should read "chelate recording materials".

Column 2, line 12, "further comprising" should read --further comprise--.
line 16, "further comprises" should read --further comprise--.

Column 5, line 44, "alcohol," should read --alcohol.--.

Column 8, line 28, "may a case," should read --may be a case--.

Column 9, line 43, "zinc ton," should read --zinc ion--.

UNITED STATES PATENT AND TRADEMARK OFFICE
CERTIFICATE OF CORRECTION

PATENT NO. : 5,489,501

DATED : FEBRUARY 6, 1996

INVENTOR(S) : Torii et al.

It is certified that error appears in the above-identified patent and that said Letters Patent is hereby corrected as shown below:

Column 12, line 45, "EXAMPLE 9",
should read --EXAMPLE 10--.
line 54, "EXAMPLE 10",
should read --EXAMPLE 11-.
line 61, "12HiO" should read --$12H_2O$--
Column 13, line 52, "sheet No. 6"
should read --sheet No. 16--.
Column 16, line 66, "and $M^1$ is a trivalent"
should read --$M^3$ is a trivalent--.

Signed and Sealed this
Twelfth Day of November, 1996

*Attest:*

*Attesting Officer*

BRUCE LEHMAN

*Commissioner of Patents and Trademarks*